US006810377B1

(12) United States Patent
Ho et al.

(10) Patent No.: US 6,810,377 B1
(45) Date of Patent: Oct. 26, 2004

(54) LOST FRAME RECOVERY TECHNIQUES FOR PARAMETRIC, LPC-BASED SPEECH CODING SYSTEMS

(75) Inventors: Grant Ian Ho, Don Mills (CA); Marion Baraniecki, Fairfax, VA (US); Suat Yeldener, Germantown, MD (US)

(73) Assignee: Comsat Corporation, Bethesda, MD (US)

( * ) Notice: Subject to any disclaimer, the term of this patent is extended or adjusted under 35 U.S.C. 154(b) by 0 days.

(21) Appl. No.: 09/099,952

(22) Filed: Jun. 19, 1998

(51) Int. Cl.[7] ..... G10L 19/02
(52) U.S. Cl. ..... 704/208; 704/214
(58) Field of Search ..... 704/201, 205, 704/208, 214

(56) References Cited

U.S. PATENT DOCUMENTS

| | | | | | |
|---|---|---|---|---|---|
| 4,975,956 | A | | 12/1990 | Liu et al. | |
| 5,073,940 | A | * | 12/1991 | Zinser et al. | 381/47 |
| 5,163,136 | A | * | 11/1992 | Richmond | 710/30 |
| 5,255,343 | A | | 10/1993 | Su | |
| 5,305,332 | A | * | 4/1994 | Ozawa | 704/219 |
| 5,307,441 | A | * | 4/1994 | Tzeng | 395/2.31 |
| 5,359,696 | A | * | 10/1994 | Gerson et al. | 704/223 |
| 5,473,727 | A | * | 12/1995 | Nishiguchi et al. | 704/222 |
| 5,485,522 | A | * | 1/1996 | Solve et al. | 381/56 |
| 5,491,719 | A | | 2/1996 | Sellin et al. | |
| 5,495,555 | A | * | 2/1996 | Swaminathan | 704/207 |
| 5,502,713 | A | * | 3/1996 | Lagerqvist et al. | 370/252 |
| 5,572,622 | A | | 11/1996 | Wigren et al. | |
| 5,598,506 | A | | 1/1997 | Wigren et al. | |
| 5,699,477 | A | * | 12/1997 | McCree | 395/2.25 |
| 5,699,478 | A | * | 12/1997 | Nahumi | 704/226 |
| 5,699,485 | A | * | 12/1997 | Shoham | 395/2.32 |
| 5,732,389 | A | * | 3/1998 | Kroon et al. | 704/223 |
| 5,765,127 | A | * | 6/1998 | Nishiguchi et al. | 704/208 |
| 5,778,335 | A | * | 7/1998 | Ubale et al. | 704/219 |
| 5,778,338 | A | * | 7/1998 | Jacobs et al. | 704/223 |
| 5,859,664 | A | * | 1/1999 | Dent | 348/21 |
| 5,862,518 | A | * | 1/1999 | Nomura et al. | 704/214 |
| 5,878,388 | A | * | 3/1999 | Nishiguchi et al. | 704/214 |
| 5,890,108 | A | * | 3/1999 | Yeldener | 704/200.1 |
| 5,899,968 | A | * | 5/1999 | Navarro et al. | 704/220 |
| 5,907,822 | A | * | 5/1999 | Prieto, Jr. et al. | 704/202 |
| 5,909,663 | A | * | 6/1999 | Iijima et al. | 704/226 |
| 5,918,205 | A | * | 6/1999 | Dierke | 704/230 |
| 5,924,062 | A | * | 7/1999 | Maung | 704/217 |
| 5,960,389 | A | * | 9/1999 | Jarvinen et al. | 704/220 |
| 6,347,081 | B1 | * | 2/2002 | Bruhn | 370/337 |
| 6,418,408 | B1 | * | 7/2002 | Udaya Bhaskar et al. | 704/219 |
| 2002/0091523 | A1 | * | 7/2002 | Makinen et al. | 704/258 |

FOREIGN PATENT DOCUMENTS

| | | |
|---|---|---|
| EP | 0 459 358 A2 | 12/1991 |

* cited by examiner

*Primary Examiner*—Susan McFadden
*Assistant Examiner*—Michael N. Opsasnick
(74) *Attorney, Agent, or Firm*—Sughrue Mion, PLLC

(57) ABSTRACT

A lost frame recovery technique for LPC-based systems employs interpolation of parameters from previous and subsequent good frames, selective attenuation of frame energy when the energy of a subframe exceeds a threshold, and energy tapering in the presence of multiple successive lost frames.

4 Claims, 2 Drawing Sheets

G.723.1 Decoder Operation

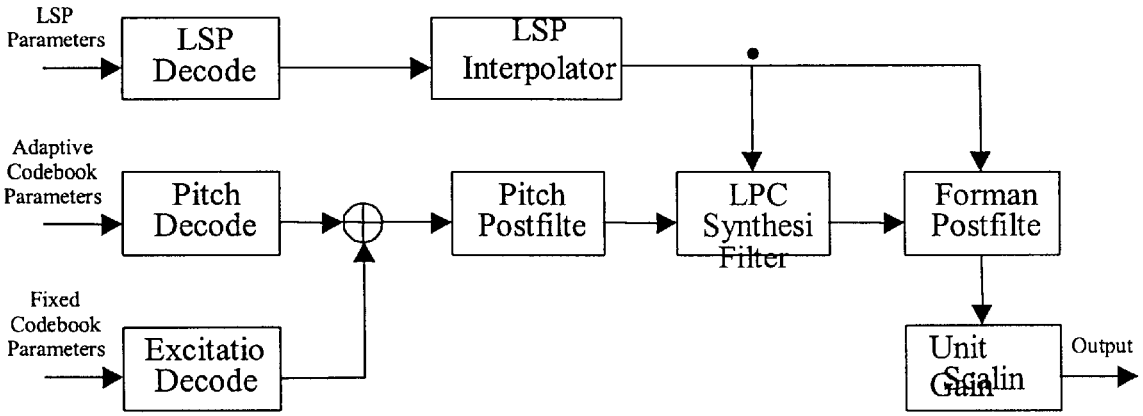
Figure 1. G.723.1 Decoder Operation
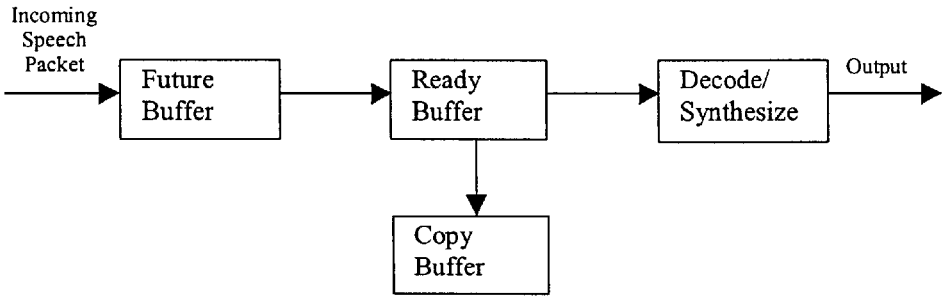
Figure 2: Linear Interpolation Setup at the Decoder Fig. 3a: Original Speech Segment (No Packet Loss)
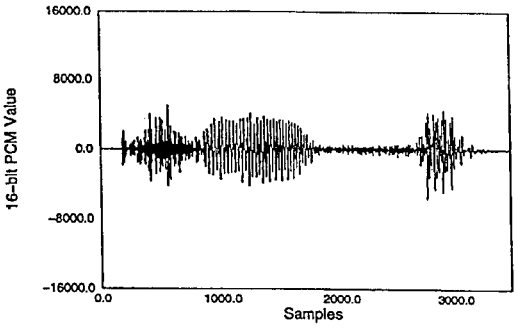
Fig. 4a: Original Speech Segment (No Packet Loss)
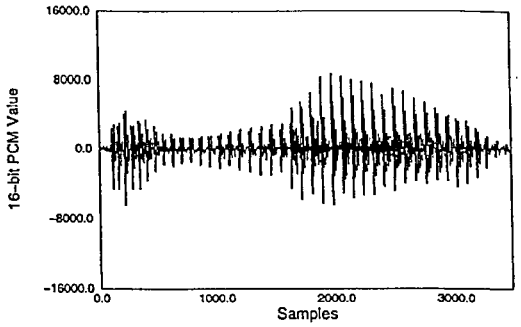
Fig. 3b: G.723.1 Error Concealment (15% Packet Loss)
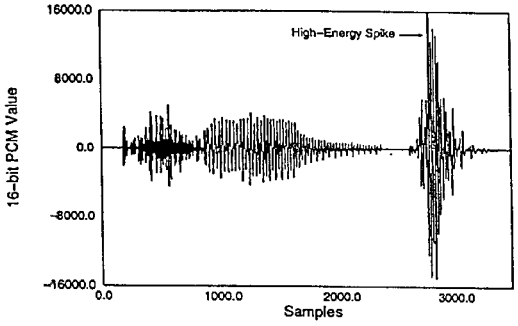
Fig. 4b: G.723.1 Error Concealment (15% Packet Loss)
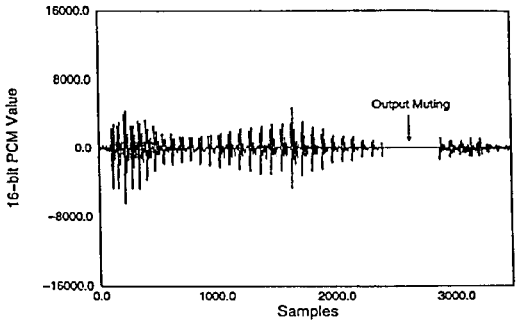
Fig. 3c: Improved Error Concealment (15% Packet Loss)
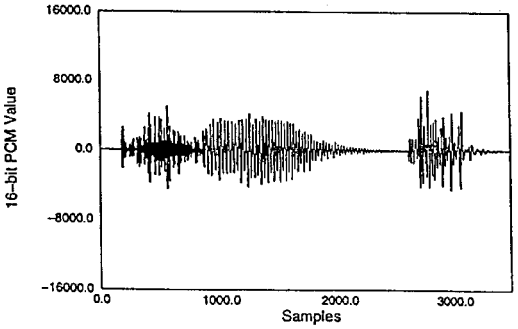
Fig. 4c: Improved Error Concealment (15% Packet Loss)
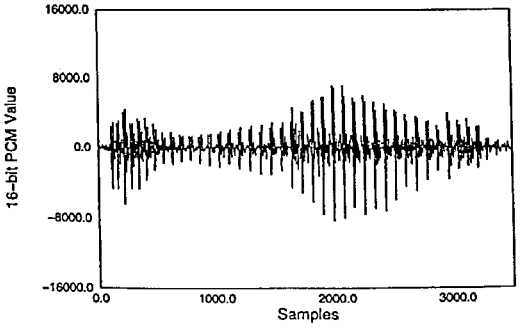

LOST FRAME RECOVERY TECHNIQUES FOR PARAMETRIC, LPC-BASED SPEECH CODING SYSTEMS

BACKGROUND OF THE INVENTION

The transmission of compressed speech over packet-switching and mobile communications networks involves two major systems. The source speech system encodes the speech signal on a frame by frame basis, packetizes the compressed speech into bytes of information, or packets, and sends these packets over the network. Upon reaching the destination speech system, the bytes of information are unpacketized into frames and decoded. The G.723.1, dual rate speech coder, described in *ITU-T Recommendation G.*723.1, "Dual Rate Speech Coder for Multimedia Communications Transmitting at 5.3 and 6.3 kbit/s," March 1996 (hereafter "Reference 1", and incorporated herein by reference) was ratified by the ITU-T in 1996 and has since been used to add voice over various packet-switching as well as mobile communications networks. With a mean opinion score of 3.98 out of 5.0 (see, Thryft, A. R., "Voice over IP Looms for Intranets in '98," *Electronic Engineering Times*, August, 1997, Issue: 967, pp. 79, 102, hereafter "Reference 2", and incorporated herein by reference), the near toll quality of the G.723.1 standard is ideal for real-time multimedia applications over private and local area networks (LANs) where packet loss is minimal. However, over wide area networks (WANs), global area networks (GANs), and mobile communications networks, congestion can be severe, and packet loss may result in heavily degraded speech if left untreated. It is therefore necessary, to develop techniques to reconstruct lost speech frames at the receiver in order to minimize distortion and maintain output intelligibility.

The following discussion of the G.273.1 dual rate coder and its error concealment will assist in a full understanding of the invention.

The G.723.1 dual rate speech coder encodes 16-bit linear pulse-code modulated (PCM) speech, sampled at a rate of 8 KHz, using linear predictive analysis-by-synthesis coding. The excitation for the high rate coder is Multipulse Maximum Likelihood Quantization (MP-MLQ) while the excitation for the low rate coder is Algebraic-Code-Excited Linear-Prediction (ACELP). The encoder operates on a 30 ms frame size, equivalent to a frame length of 240 samples, and divides every frame into four subframes of 60 samples each. For every 30 ms speech frame, a 10th order Linear Prediction Coding (LPC) filter is computed and its coefficients are quantized in the form of Line Spectral Pair (LSP) parameters for transmission to the decoder. An adaptive codebook pitch lag and pitch gain are then calculated for every subframe and transmitted to the decoder. Finally, the excitation signal, consisting of the fixed codebook gain, pulse positions, pulse signs, and grid index, is approximated using either MP-MLQ for the high rate coder or ACELP for the low rate coder, and transmitted to the decoder. In sum, the resulting bitstream sent from encoder to decoder consists of the LSP parameters, adaptive codebook lags, fixed and adaptive codebook gains, pulse positions, pulse signs, and the grid index.

At the decoder, the LSP parameters are decoded and the LPC synthesis filter generates reconstructed speech. For every subframe, the fixed and adaptive codebook contributions are sent to a pitch postfilter, whose output is input to the LPC synthesis filter. The output of the synthesis filter is then sent to a formant postfilter and gain scaling unit to generate the synthesized output. In the case of indicated frame erasures, an error concealment strategy, described in the following subsection, is provided. FIG. 1 displays a block diagram of the G.723.1 decoder.

In the presence packet of losses, current G.723.1 error concealment involves two major steps. The first step is LSP vector recovery and the second step is excitation recovery. In the first step, the missing frame's LSP vector is recovered by applying a fixed linear predictor to the previously decoded LSP vector. In the second step, the missing frame's excitation is recovered using only the recent information available at the decoder. This is achieved by first determining the previous frame's voiced/unvoiced classifier using a cross-correlation maximization function and then testing the prediction gain for the best vector. If the gain is more than 0.58 dB, the frame is declared as voiced, otherwise, the frame is declared as unvoiced. The classifier then returns a value of 0 if the previous frame is unvoiced, or the estimated pitch lag if the previous frame is voiced. In the unvoiced case, the missing frame's excitation is then generated using a uniform random number generator and scaled by the average of the gains for subframes 2 and 3 of the previous frame. Otherwise, for the voiced case, the previous frame is attenuated by 2.5 dB and regenerated with a periodic excitation having a period equal to the estimated pitch lag. If packet losses continue for the next two frames, the regenerated excitation is attenuated by an additional 2.5 dB for each frame, but after three interpolated frames, the output is completely muted, as described in Reference 1.

The G.723.1 error concealment strategy was tested by sending various speech segments over a network with packet loss levels of 1%, 3%, 6%, 10%, and 15%. Single as well as multiple packet losses were simulated for each level. Through a series of informal listening tests, it was shown that although the overall output quality was very good for lower levels of packet loss, a number of problems persisted at all levels and became increasingly severe as packet loss increased.

First, parts of the output segment sounded unnatural and contained many annoying, metallic-sounding artifacts. The unnatural sounding quality of the output can be attributed to LSP vector recovery based on a fixed predictor as previously described. Since the missing frame's LSP vector is recovered by applying a fixed predictor to the previous frame's LSP vector, the spectral changes between the previous and reconstructed frames are not smooth. As a result of the failure to generate smooth spectral changes across missing frames, unnatural sounding output quality occurs, which increases unintelligibility during high levels of packet loss. In addition, many high-frequency, metallic-sounding artifacts were heard in the output. These metallic-sounding artifacts primarily occur in unvoiced regions of the output, and are caused by incorrect voicing estimation of the previous frame during excitation recovery. In other words, since a missing, unvoiced frame may incorrectly be classified as voiced, then transition into the missing frame will generate a high-frequency glitch, or metallic-sounding artifact, by applying the estimated pitch lag computed for the previous frame. As packet loss increases, this problem becomes even more severe, as incorrect voicing estimation generates increased distortion.

Another problem using G.723.1 error concealment was the presence of high-energy spikes in the output. These high-energy spikes, which are especially uncomfortable for the ear, are caused by incorrect estimation of the LPC coefficients during formant postfiltering, due to poor prediction of the LSP or gain parameter, using G.723.1 fixed LSP prediction and excitation recovery. Once again, as packet loss increases, the number of high-energy spikes also increases, leading to greater listener discomfort and distortion.

Finally, "choppy" speech, resulting from complete muting of the output, was evident. Since G.723.1 error concealment reconstructs no more than three consecutive missing frames, all remaining missing frames are simply muted, leading to patches of silence in the output, or "choppy" speech. Since there is a greater probability that more than three consecutive packets may be lost in a network, when packet loss increases, this will lead to increased "choppy" speech and hence, decreased intelligibility and distortion at the output.

SUMMARY OF THE INVENTION

It is an object of the present invention to eliminate the above problems and improve upon the error concealment strategy defined in Reference 1. This and other objects are achieved by an improved lost frame recovery technique employing linear interpolation, selective energy attenuation, and energy tapering.

Linear interpolation of the speech model parameters is a technique designed to smooth spectral changes across frame erasures and hence, eliminate any unnatural sounding speech and metallic-sounding artifacts from the output. Linear interpolation operates as follows: 1) At the decoder, a buffer is introduced to store a future speech frame or packet. The previous and future information stored in the buffer are used to interpolate the speech model parameters for the missing frame, thereby generating smoother spectral changes across missing frames than if a fixed predictor were simply used, as in G.723.1 error concealment, 2) Voicing classification is then based on both the estimated pitch value and predictor gain for the previous frame, as opposed to simply the predictor gain as in G.723.1 error concealment; this improves the probability of correct voicing estimation for the missing frame. By applying the first part of the linear interpolation technique, more natural-sounding speech is achieved; by applying the second part of the linear interpolation technique, almost all unwanted metallic-sounding artifacts are effectively masked away.

To eliminate the effects of high-energy spikes, a selective energy attenuation technique was developed. This technique checks the signal energy for every synthesized subframe against a threshold value, and attenuates all signal energies for the entire frame to an acceptable level if the threshold is exceeded. Combined with linear interpolation, this selective energy attenuation technique effectively eliminates all instances of high-energy spikes from the output.

Finally, an energy tapering technique was designed to eliminate the effects of "choppy" speech. Whenever multiple packets are lost in excess of one frame, this technique simply repeats the previous good frame for every missing frame by gradually decreasing the repeated frame's signal energy. By employing this technique, the energy of the output signal is gradually smoothed or tapered over multiple packet losses, thus eliminating any patches of silence or a "choppy" speech effect evident in G.723.1 error concealment. Another advantage of energy tapering is the relatively small amount of computation time required for reconstructing lost packets. Compared to G.723.1 error concealment, since this technique only involves gradual attenuation of the signal energies for repeated frames, as opposed to performing G.723.1 fixed LSP prediction and excitation recovery, the total algorithmic delay is considerably less.

BRIEF DESCRIPTION OF THE DRAWING

The invention will be more clearly understood from the following description in conjunction with the accompanying drawing, wherein:

FIG. 1 is a block diagram showing G.723.1 decoder operation;

FIG. 2 is a block diagram illustrating the use of Future, Ready and Copy buffers in the interpolation technique according to the present invention;

FIGS. 3*a*–3*c* are waveforms illustrating the elimination of high energy spikes by the error concealment technique of the present invention; and FIGS. 4*a*–4*c* are waveforms illustrating the elimination of output muting by the error concealment technique according to the present invention.

DETAILED DESCRIPTION OF THE INVENTION

The present invention comprises three techniques used to eliminate the problems discussed above that arise from G.723.1 error concealment, namely, unnatural sounding speech, metallic-sounding artifacts, high-energy spikes, and "choppy" speech. It should be noted that the described error concealment techniques are applicable to different types of parametric, Linear Predictive Coding (LPC) based speech coders (e.g. APC, RELP, RPE-LPC, MPE-LPC, CELP, SELP, CELP-BB, LD-CELP, and VSELP) as well as different packet-switching (e.g. Internet, Asynchronous Transfer Mode, and Frame Relay) and mobile communications (e.g., mobile satellite and digital cellular) networks. Thus, while the invention will be described in the context of the G.723.1 MP-MLQ. 6.3 Kbps coder over the Internet, with the description using terminology associated with this particular speech coder and network, the invention is not to be so limited, but is readily applicable to other parametric, LPC-based speech coders (e.g., the low rate ACELP coder as well as other similar coders) and to different networks.

Linear Interpolation

Linear interpolation of the speech model parameters was developed to smooth spectral changes across a single frame erasure (i.e. a missing frame in between two good speech frames) and hence, generate more natural sounding output while eliminating any metallic-sounding artifacts from the output. The setup of the linear interpolation system is illustrated in FIG. 2. Linear interpolation requires three buffers—the Future Buffer, Ready Buffer, and Copy Buffer, each of which is equivalent to one 30 ms frame length. These buffers are inserted at the receiver before decoding and synthesis takes place. Before describing this technique, it is first necessary to define the following terms as applied to linear interpolation:

- previous frame, is the last good frame that was processed by the decoder, and is stored in the Copy Buffer.
- current frame, is a good or missing frame that is currently being processed by the decoder, and is stored in the Ready Buffer.
- future frame, is a good or missing frame immediately following the current frame, and is stored in the Future Buffer.

Linear Interpolation is a Multi-step Procedure that Operates as Follows:

1. The Ready Buffer stores the current good frame to be processed while the Future Buffer stores the future frame of the encoded speech sequence. A copy of the current frame's speech model parameters is made and stored in the Copy Buffer.

2. The status of the future frame, either good or missing, is determined. If the future frame is good, no linear interpolation is necessary; and the linear interpolation flag is reset to 0. If the future frame is missing, linear interpolation might be necessary; and the linear interpolation flag is temporarily set to 1. (In a real-time system, a missing frame is detected by either a receiver timeout or Cyclical Redundancy Check (CRC) failure. These missing frame detection algorithms however, are not part of the invention, but must be recognized and incorporated at the decoder for proper operation of any packet reconstruction strategy.)
3. The current frame is decoded and synthesized. A copy of the current frame's LPC synthesis filter and pitch postfiltered excitation are made.
4. The future frame, originally in the Future Buffer, becomes the current frame and is stored in the Ready Buffer. The next frame in the encoded speech sequence arrives as the future frame in the Future Buffer.
5. The value of the linear interpolation flag is checked. If the flag is set to 0, the process jumps back to step (1). If the flag is set to 1, the process jumps to step (6).
6. The status of the future frame is determined. If the future frame is good, linear interpolation is applied; the linear interpolation flag remains set to 1 and the process jumps to step (7). If the future frame is missing, energy tapering is applied; the energy tapering flag is set to 1 and the linear interpolation flag is reset to 0. (Note: The energy tapering technique is applied only for multiple frame losses and will be described later herein.)
7. LSP recovery is performed. Here, the 10th order LSP vectors from the previous and future good frames, stored in the Copy and Future Buffers respectively, are averaged to obtain the LSP vector for the current frame.
8. Excitation recovery is performed. Here, the fixed codebook gains from the previous and future frames, stored in the Copy and Future Buffers, are averaged to obtain the fixed codebook gain for the missing frame. All remaining speech model parameters are taken from the previous frame.
9. Pitch lag and predictor gain estimation are performed for the previous frame, stored in the Copy Buffer, with the identical procedure to G.723.1 error concealment.
10. If the predictor gain is less than 0.58 dB, the frame is declared unvoiced, and the excitation signal for the current frame is generated using a random number generator and scaled by the previously calculated averaged fixed codebook gain in step (8).
11. If the predictor gain is greater than 0.58 dB and the estimated pitch lag exceeds a threshold value $P_{thresh}$, the frame is declared voiced, and the excitation signal for the current frame is generated by first attenuating the previous excitation by 1.25 dB for every two subframes, and then regenerating this excitation with a period equal to the estimated pitch lag. Otherwise, the current frame is declared unvoiced and the excitation is recovered as in step (10).
12. After LSP and excitation recovery, the current frame, with its newly interpolated LSP and gain parameters, is decoded and synthesized and the process jumps back to step (13).
13. The future frame, originally in the Future Buffer, becomes the current frame and is stored in the Ready Buffer. The next frame in the encoded speech sequence arrives as the future frame in the Future Buffer. The process then returns to step (1).

There are at least two important advantages of linear interpolation over G.723.1 error concealment. The first advantage occurs in step (7), during LSP recovery. In Step (7), since linear interpolation determines the missing frame's LSP parameters based on the previous and future frames, this provides a better estimate for the missing frame's LSP parameters, thereby enabling smoother spectral changes across the missing frame, than if fixed LSP prediction were simply used, as in G.723.1 error concealment. As a result, more natural sounding, intelligible speech is generated, thereby increasing comfortability for the listener.

The second advantage of linear interpolation occurs in steps (8) to (11), during excitation recovery. First, in step (8), since linear interpolation generates the missing frame's gain parameters by averaging the fixed codebook gains between the previous and future frames, it provides a better estimate for the missing frame's gain, as opposed to the technique described in G.723.1 error concealment. This interpolated gain, which is then applied for unvoiced frames in step (10), thereby generates smoother, more comfortable sounding gain transitions across frame erasures. Secondly, in step (11), voicing classification is based on the both the predictor gain and estimated pitch lag, as opposed to the predictor gain alone, as in G.723.1 error concealment. That is, frames whose predictor gain is greater than 0.58 dB are also compared against a threshold pitch lag, $P_{thresh}$. Since unvoiced frames are primarily composed of high-frequency spectra, those frames that have low estimated pitch lags, and hence, high estimated pitch frequencies, thereby have a higher probability of being unvoiced. Thus, frames whose estimated pitch lags fall below $P_{thresh}$ are declared unvoiced and those whose estimated pitch lags exceed $P_{thresh}$, are declared voiced. In sum, by selectively determining a frame's voicing classification based on both the predictor gain and estimated pitch lag, the technique of this invention effectively masks away all occurrences of high-frequency, metallic-sounding artifacts occurring in the output. As a result, overall intelligibility and listener comfortability is increased.

Selective Energy Attenuation

Selective energy attenuation was developed to eliminate instances of high-energy spikes heard using G.723.1 error concealment. Referring to FIG. 1, these high-energy spikes are caused by incorrect estimation of the LPC coefficients during formant post-filtering, due to poor prediction of the LSP or gain parameters by G.723.1 error concealment. To provide better estimates for a missing frame's LSP and gain parameters, linear interpolation was developed as previously described. In addition, the signal energy for every synthesized subframe, after formant postfiltering, is checked against a threshold energy, $S_{thresh}$. If the signal energy for any one the four subframes exceeds $S_{thresh}$, then the signal energies for all remaining subframes are attenuated to an acceptable energy level, $S_{max}$. Combined with linear interpolation, this selective energy attenuation technique effectively eliminates all instances of high-energy spikes, without adding noticeable degradation to the output. Overall, speech intelligibility and especially, listener comfortability is increased. FIG. 3*b* shows the presence of a high-energy spike due to G.723.1 error concealment; FIG. 3*c* shows elimination of the high-energy spike due to selective energy attenuation and linear interpolation.

Energy Tapering

Energy tapering was developed to eliminate the effects of "choppy" speech generated by G.723.1 error concealment. As recalled, "choppy" speech results when G.723.1 error concealment completely mutes the output after three missing frames are reconstructed. As a result, patches of silence are generated at the output, thereby decreasing intelligibility and producing "choppy" speech. To eliminate this problem, a multi-step energy tapering technique was designed. By referring to FIG. 2, this technique operates as follows:

1. The Ready Buffer stores the current good frame to be processed while the Future Buffer stores the future frame of the encoded speech sequence. A copy of the current frame's speech model parameters is made and stored in the Copy Buffer.
2. The status of the future frame, either good or missing, is determined. If the future frame is good, no linear interpolation is necessary; the linear interpolation is reset to 0. If the future frame is missing, linear interpolation might be necessary; the linear interpolation flag is temporarily set to 1.
3. The current frame is decoded and synthesized. A copy of the current frame's LPC synthesis filter and pitch postfiltered excitation is made.
4. The future frame, originally in the Future Buffer, becomes the current frame and is stored in the Ready Buffer. The next frame in the encoded speech sequence arrives as the future frame in the Future Buffer.
5. The value of the linear interpolation flag is checked. If the flag is set to 0, the process jumps back to step (1). If the flag is set to 1, the process jumps to step (6).
6. The status of the future frame is determined. If the future frame is good, linear interpolation is applied as described in subsection 3.1. If the future frame is missing, energy tapering is applied; the energy tapering flag is set to 1, the linear interpolation flag is reset to 0, and the process jumps to step (7).
7. The copy of the previous frame's pitch postfiltered excitation, from step (3), is attenuated by (0.5×value of energy tapering flag) dB.
8. The copy of the previous frame's LPC synthesis filter, from step (3), is used to synthesize the current frame using the attenuated excitation in step (7).
9. The future frame, originally in the Future Buffer, becomes the current frame and is stored in the Ready Buffer. The next frame in the encoded speech sequence arrives as the future frame in the Future Buffer.
10. The current frame is synthesized using steps (7) to (9), then jumps to step (11).
11. The status of the future frame is determined. If the future frame is good, no further energy tapering is applied; the energy tapering flag is reset to 0, and the process jumps to step (12). If the future frame is missing, further energy tapering is applied; the energy tapering flag is incremented by 1, and the process jumps to step (11).
12. The future frame, originally in the Future Buffer, becomes the current frame and is stored in the Ready Buffer. The next frame in the encoded speech sequence arrives as the future frame in the Future Buffer. The process jumps back to step (1).

By employing this technique, the energy of the output signal is gradually tapered over multiple packet losses, and hence, eliminates the effects of "choppy" speech by complete output muting. FIG. 4*b* shows the presence of complete output muting due to G.723.1 error concealment; FIG. 4*c* shows elimination of output muting due to energy tapering. As FIG. 4*c* illustrates, the output is gradually tapered over multiple packet losses, thereby eliminating any segments of pure silence from the output and generating greater intelligibility for the listener.

As discussed above, one of the clear advantages of energy tapering over G.723.1 error concealment, besides improved output intelligibility, is the relatively lower amount of computation time required. Since energy tapering only repeats the previous frame's LPC synthesis filter and attenuates the previous frame's pitch postfiltered gain, the total algorithmic delay is considerably less compared to performing full-scale LSP and excitation recovery, as in G.723.1 error concealment. This approach minimizes the overall delay in order to provide the user with a more robust, real-time communications system.

Improved Results of the Invention

The three error concealment techniques were tested for various speakers under the identical levels of packet loss carried out using G.723.1 error concealment. A series of informal listening tests indicated that for all levels of packet loss, the quality of the output speech segment was significantly improved in the following ways: First, more natural sounding speech and effective masking away of all metallic-sounding artifacts were achieved due to smoother spectral transitions across missing frames based on linear interpolation and improved voicing classification. Secondly, all high-energy spikes were eliminated due to selective energy attenuation and linear interpolation. Finally, all instances of "choppy" speech were eliminated due to energy tapering. It is important to realize that as network congestion levels increase, the amount of packet loss also increases. Thus, in order to maintain real-time speech intelligibility, it is essential to develop techniques to successfully conceal frame erasures while minimizing the amount of degradation at the output. The strategies developed by the authors represent techniques which provide improved output speech quality, are most robust in the presence of frame erasures compared to the techniques described in Reference 1, and can be easily applied with any parametric, LPC-based speech coder over any packet-switching or mobile communications network.

It will be appreciated that various changes and modifications may be made to the specific embodiments described above without departing from the spirit and scope of the invention as defined in the appended claims.

What is claimed is:

1. A method of recovering multiple lost frames in a system of the type wherein information is transmitted as successive frames of encoded signals including at least LSP parameters and excitation gain, and the information is reconstructed from said encoded signals at a receiver, said method comprising:

storing encoded signals from a first frame prior to said multiple successive lost frames;

storing encoded signals from a second frame subsequent to said multiple successive lost frames;

interpolating between the LSP parameters from said first and second frames and between said excitation gain from said first and second frames to obtain recovered encoded signals for said multiple successive lost frames; and repeating the encoded signals for a frame immediately preceding said multiple successive lost frames while gradually reducing the signal energy for each recovered frame.

2. A method according to claim 1, wherein said encoded signals include a plurality of Line Spectral Pair (LSP) parameters corresponding to each frame, and said interpolating step comprises interpolating between the LSP parameters of said first frame and the LSP parameters of said second frame.

3. A method of recovering multiple successive lost frames in a system of the type wherein information is transmitted as successive frames of encoded signals and the information is reconstructed from said encoded signals at a receiver, said method comprising:

storing encoded signals from a first frame prior to said multiple successive lost frames;

storing encoded signals from a second frame subsequent to said multiple successive lost frames; and interpolating between the encoded signals from said first and second frames to obtain recovered encoded signals for said multiple successive lost frames, wherein on loss of multiple successive frames, said method comprises the step of repeating the encoded signals for a frame immediately preceding said multiple successive lost frames while gradually reducing on a subframe-by-subframe basis the signal energy, comprising non-noise energy, for each recovered frame.

4. A method recovering multiple successive lost frames in a system of the type wherein information is transmitted as successive frames of encoded signals and the information is reconstructed from said encoded signals at a receiver, said method comprising:

storing encoded signals from a first frame prior to said multiple successive lost frames;

storing encoded signals from a second frame subsequent to said multiple successive lost frames;

interpolating between the encoded signals from said first and second frames to obtain recovered encoded signals for said multiple successive lost frames, wherein said encoded signals include said LSP parameters, fixed codebook gains and further excitation signals, said method comprising interpolating said fixed codebook gain of said multiple successive lost frames from the fixed codebook gains of said first and second frames, and adopting said further excitation signals from said first frame as the further excitation signals of said multiple successive lost frames; and repeating the encoded signals for a frame immediately preceding said multiple successive lost frames while gradually reducing the signal energy for each recovered frame.

* * * * *